US005667266A

United States Patent [19]

Giocanti

[11] Patent Number: 5,667,266

[45] Date of Patent: Sep. 16, 1997

[54] DEVICE FOR CARRYING LOADS

[76] Inventor: Xavier Giocanti, Les Romarins, Allée des Pins, 84 boulevard du Redon, Marseille F-13009, France

[21] Appl. No.: 663,078

[22] PCT Filed: Dec. 22, 1993

[86] PCT No.: PCT/FR93/01291

§ 371 Date: Jun. 24, 1996

§ 102(e) Date: Jun. 24, 1996

[87] PCT Pub. No.: WO95/17114

PCT Pub. Date: Jun. 29, 1995

[51] Int. Cl.[6] ..... B65D 33/06

[52] U.S. Cl. ..... 294/170; 294/159

[58] Field of Search ..... 294/137, 158, 294/159, 170, 171; D9/434; 383/6, 13, 25; 16/114 R

[56] References Cited

U.S. PATENT DOCUMENTS

| | | | |
|---|---|---|---|
| D. 159,141 | 6/1950 | Conrad | D9/434 |
| D. 340,863 | 11/1993 | Daigle | D9/434 |
| 3,757,911 | 9/1973 | Potter . | |
| 4,991,894 | 2/1991 | Rutens . | |
| 5,181,757 | 1/1993 | Montoya | 294/170 |

FOREIGN PATENT DOCUMENTS

| | | | |
|---|---|---|---|
| 46087/79 | 10/1979 | Australia . | |
| 1248501 | 1/1989 | Canada . | |
| 388910 | 8/1908 | France . | |
| 1356457 | 3/1964 | France . | |
| 2195561 | 3/1974 | France . | |
| 2541099 | 8/1984 | France | 294/170 |
| 2632933 | 12/1989 | France . | |
| 2695630 | 3/1994 | France . | |
| 3528037 | 2/1987 | Germany . | |
| 224527 | 3/1943 | Switzerland . | |
| WO91/11368 | 8/1991 | WIPO . | |

*Primary Examiner*—Dean Kramer

*Attorney, Agent, or Firm*—Greenblum & Bernstein, P.L.C.

[57] ABSTRACT

A grip for carrying bags having loop handles, or other loads, includes an elongate central body or grip with ends shaped to form hooks for carrying the bag or other loads. The central body is flexible so that it can bend under the weight of a load hanging from or hooked onto its hook-shaped ends.

7 Claims, 2 Drawing Sheets

DEVICE FOR CARRYING LOADS

The present invention relates to a device for facilitating the carrying of bags having loop handles, or other loads such as tied up parcels, paint pots, ski boots, etc., that are capable of being hooked to said device.

A grip for facilitating the carrying of lightweight packages closed by means of a tie has been proposed (FR-A-1.356.457), and is constituted by a tube made of wood or cardboard in which a metal shaft, ended at each of its ends by a hook, passes in order to enable the string surrounding the package to be transported to be hung thereon.

This grip, made out of two heteroclite materials (wood/metal or cardboard/metal), has the following disadvantages:

In the case where the tube is made of wood, the transport is relatively uncomfortable, due especially to the rigidity of its central body which does not generate any shock absorbing effect during walking, the shocks resulting from the oscillations caused by the carrier's walk being integrally transmitted to his hand and arm, these shocks further promoting the ill-timed tearing of the hanging bags;

the difficulty in finding a balance, especially in the case of an unequal distribution of the loads at the ends of the grip, in view of the straightness of its rigid central body and of the invariable position of the suspension points of said loads, the carrier's hand thereby being constantly biased to resist this lack of balance;

if one considers that the tube will be made of a cardboard, for economical reasons, the application of a too heavy load at its ends can cause the irreversible bending of the cardboard, and even the tearing thereof, with possible unfortunate consequences for the carrier's hand which is then put into contact with the wire (shearing of the fingers)

To remedy this latter disadvantage, the document FR-A-388.910 proposes a grip, still made of heteroclite materials, but whose central portion is made of a flexible material, such as leather. However, the flexibility of the leather is limited, such that after several uses of the grip under substantial loads, it does no longer recover its initial shape. In addition, it does not permit any absorption of the shocks caused by the carrier's walk.

The object of the invention is especially to remedy these disadvantages and deficiencies of the carrying grips described in the aforementioned documents.

According to the invention, this goal is achieved due to a carrying grip whose central body forming the grip itself is made of a material having an elastic deformation capability, and in that said body includes two flexible portions or arms that are superposed, spaced apart and separated by an elongated opening extending between the end zones constituting the hooks.

The carrying grip comprising the aforementioned characteristics procures numerous advantages.

The flexibility of the grip provides an exceptional comfort during the transport of loads, on the one hand, and imparts a very substantial stability to the grip, when the latter is loaded, on the other hand.

The comfort results from the flexibility of the central portion which plays the role of a shock absorber, and thus considerably reduces the shocks caused especially by the oscillations from a user's walk.

This characteristic thus makes it possible to eliminate the pain caused to the hands by the loop handles, as well as the risks of an ill-timed tearing of the bags.

The stability is acquired by the curvature of the grip that assumes the shape of an inverted "U" under load, which makes it possible to offset the points of application of the three parallel, but opposite, forces that are exerted on the grip, namely: two downward vertical forces at the ends, and one upward vertical force in the center.

This offset creates a polygon of forces whose equilibrium is all the more stable as the loads will be heavy and the curvature, consequently, substantial, even in the case of an unequal load distribution.

The grip cannot break abruptly in view of the fact that in the case of too heavy loads hanging from its ends, it is the abutment or one of its arms that will break first, such that the carrier will be alerted and will have the time to put the bags down on the ground before the grip breaks completely.

The grip can be placed comfortably on the fore-arm or "slung" over the shoulder, which leaves at least one free hand, for example, to open a door or hold the hand of a child, etc.

The grip according to the invention can be made out of any plastic material having the desired semi-rigidity and flexibility, and it is very perforated, such that its weight can be reduced to about twenty grams while being very solid.

The aforementioned objects, characteristics and advantages, and more, will become apparent from the following description and annexed drawings, in which.

Figure 1:
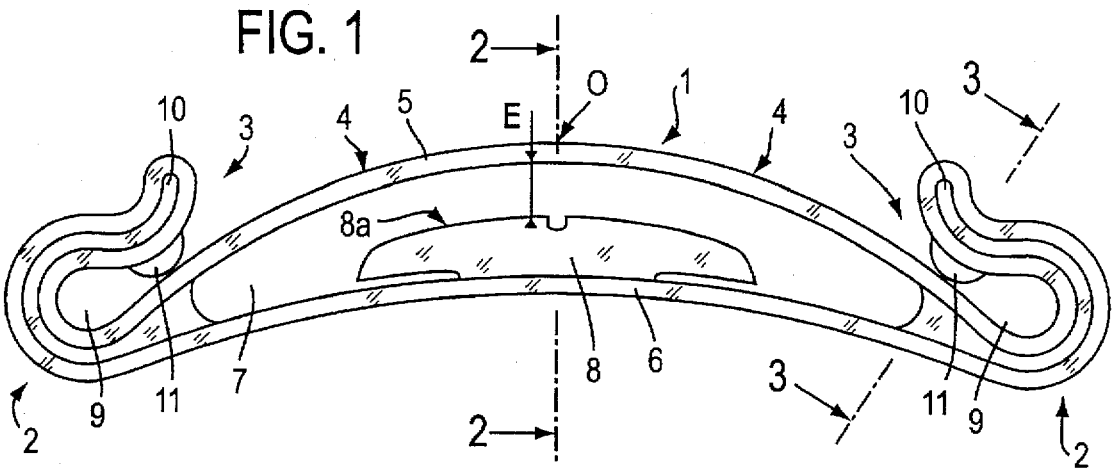
FIG. 1 is a front view of the carrying device according to the invention.

Reference is made to said drawings to describe an interesting, albeit not limiting example of embodiment of the carrying device according to the invention.

This device, or carrying grip, includes, in a manner known in itself, an elongated central body 1 constituting the grip itself, and whose end portions are shaped in a symmetrical manner to constitute hooks 2 whose inlets 3 are preferably oriented upwardly, in the direction of the central portion of said grip.

According to a first characteristic arrangement of the invention, the central body 1 forming the grip is flexible, which means that it can bend under the weight of a load hanging from or hooked to its hook-shaped end portions.

In an advantageous manner, the carrying device is in a single-piece, and it can be made out of any suitable semi-rigid material having the required flexibility or elasticity. For example, it can be cast in a single-piece in a plastic material or a semi-rigid and flexible composite material such as polyvinyl chloride, polypropylene copolymer, polyamide, etc.

According to another characteristic arrangement, the central body or grip 1 has an incurved or arched shape whose convexity is oriented upwardly considering the functional position or normal position of use of the device. According to the advantageous embodiment illustrated, the convexity of the central body thus defines, from its peak O, two opposing slopes 4 respectively ending at the inlet 3 of the hooks 2. This arrangement substantially promotes the engagement of the loop handles of the bags in the hooks 2, the loop handles sliding indeed naturally in the direction of the inlet 3 of said hooks when they are placed on the convex upper surface 4—4 of the central body 1.

According to another characteristic arrangement, the central body or grip 1 comprises two flexible portions or arms 5 and 6 that are superimposed, spaced apart and separated by an elongated opening 7 extending between the end zones constituting the hooks 2.

The inner surface of at least one of the arms 5, 6, is provided with an abutment 8 arranged to project on said inner surface and oriented in the direction of the inner surface of the other arm. A space E separates, in the rest position, the free edge of the abutment 8 and the inner surface of said other arm. According to the example illustrated, this abutment 8 is arranged in the central portion of the lower arm 6 and preferably has an elongated shape and a convex free edge 8*a* on which the concave inner surface of the upper arm can come to rest. Of course, one could provide a reverse arrangement, i.e., an abutment affixed to the inner surface of the upper arm 5 and comprising a concave free edge capable of resting on the convex inner surface of the lower arm 6.

Figure 4:
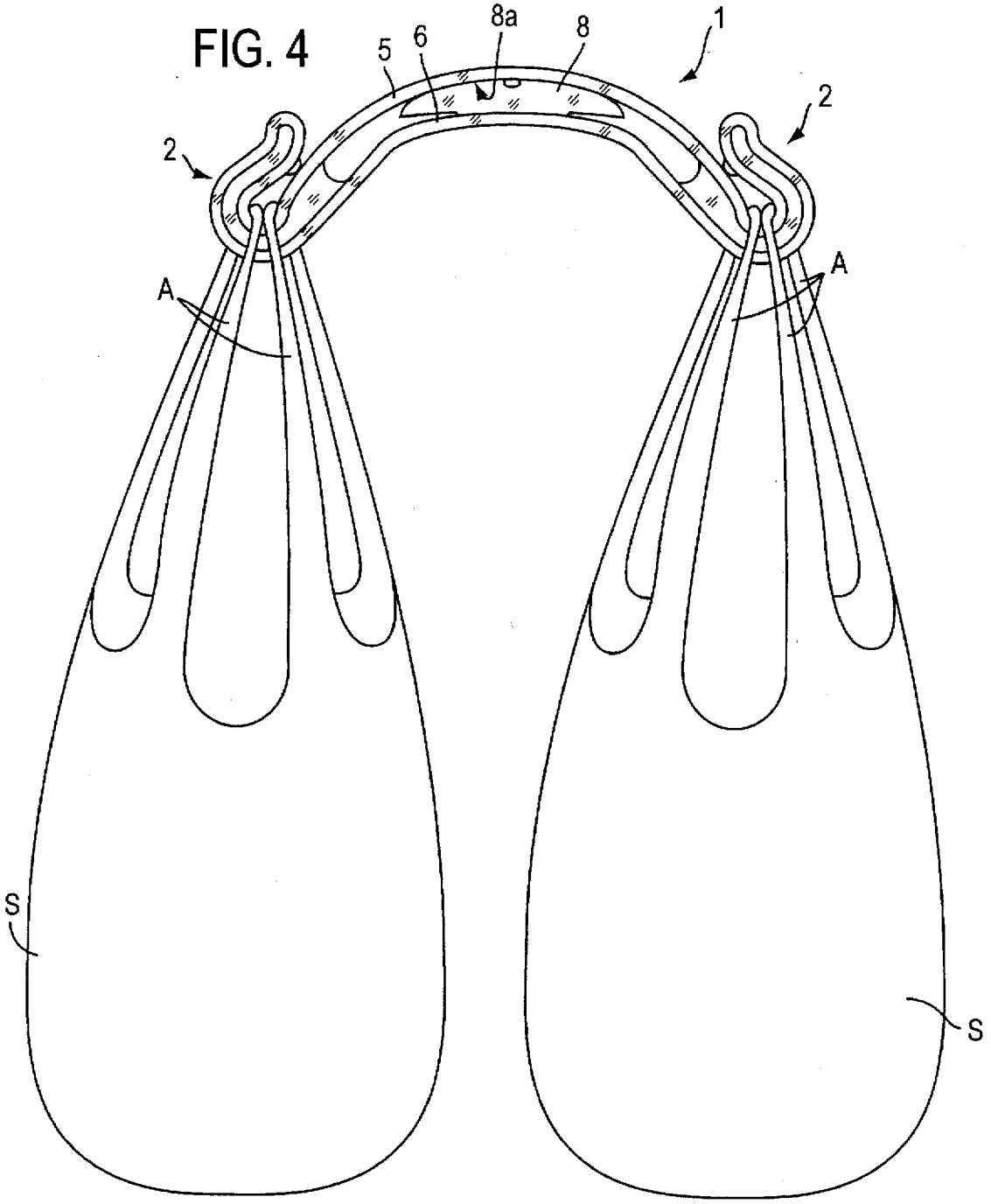
FIG. 4 is a front view illustrating an example of use of this carrying device from the ends of which bags having loop handles are hanging.

It is understood that when the central body 1 thus formed bends under the weight of loads hanging from the hooks 2 of the device, the flexing thereof is limited by the abutment 8 against the upper edge 8*a* of which the inner surface of the upper arm 5 of said central body comes to rest, as shown in FIG. 4. In this way, the grip does not assume a curvature that renders the carrying thereof uncomfortable, and it can perfectly fulfill its shock absorbing role.

Figure 2:
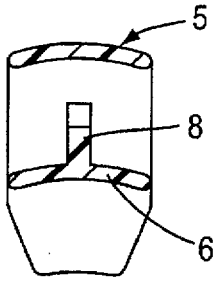
FIG. 2 is a cross sectional view along the line 2—2 of FIG. 1.
Figure 3:
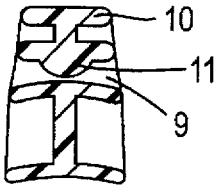
FIG. 3 is a cross sectional view along the line 3—3 of FIG. 1.

The abutment 8 preferably has a thickness that is much more reduced than the width of the arm 6, as shown in FIG. 2, which allows for a weight saving and material savings, without prejudice to the solidity of the grip.

By way of a mere example, it is indicated that the grip according to the invention can have a length on the order of 190 mm, a width on the order of 20 mm in its central portion, a spacing on the order of 17 mm between its arms 5 and 6, which arms can have a thickness on the order of 2 to 3 mm.

Each end portion or hook 2 of the device forms a loop extending from the end of the central body and rising above this end while demarcating a housing 9 for the loop handles A of the bags S, or for the ties or other elements of the loads carried, the free end portion 10 of the hook extending above the end of said central body.

The end of the free end portion 10 of the hooks 2 is spaced from the convex upper surface 4 of the central body 1, so as to present an inlet 3 whose walls converge in the direction of the end of housing 9, which is demarcated by a surface having a rounded profile.

In its portion that is the closest to the upper surface 4 of the central body 1, the free end portion 10 of the hooks 2 is provided, on its inner surface, with a round boss 11 that is practically in contact with said upper surface. The elasticity of the material of which the device is made makes it possible to space the free end portion 10 of the hooks 2 to allow for the passage of the loop handles of the bags, ties or other hooking elements, during their engagement in the housings 9, or during their removal from these housings. However, the bosses 11 efficiently prevent the undesired exit of the loop handles of the bags, ties and other hooking elements retained in the housings 9, which makes it possible especially to maintain the bags closed and prevent their contents from spilling unluckily, when they are placed on the ground or in a car.

Likewise, the bosses 11 could be provided on the upper surface 4 of the ends of the central body 1, opposite the inner surface of the free end portion 10 of the hooks 2.

What is claimed:

1. Grip for carrying bags having loop handles, or other loads, comprising:

an elongated central body having end portions shaped to constitute hooks for hanging said bags or other loads, said central body being made of a material having an elastic deformation capability;

wherein said central body includes two flexible portions or arms that are superposed, spaced apart, and separated by an elongated opening extending between the end portions constituting the hooks;

wherein at least one of the arms has an inner surface provided with an abutment arranged to project on said inner surface and oriented in a direction of an inner surface of the other arm; and wherein a space separates, at rest, a free edge of the abutment and the inner surface of said other arm.

2. Grip for carrying bags having loop handles, or other loads according to claim 1, wherein the central body has an incurred or arched shape whose convexity is oriented upwardly considering the functional position or normal position of use of said grip.

3. Grip for carrying bags having loop handles, or other loads according to claim 2, wherein inlets of the hooks are oriented upwardly in a direction of a median portion of the central body, and wherein an upper surface of the central body defines, from a peak of the central body, two opposing slopes respectively ending at the inlets of said hooks.

4. Grip for carrying bags having loop handles, or other loads according to claim 1, wherein the abutment is provided on the inner surface of a lower arm of the central body.

5. Grip for carrying bags having loop handles, or other loads according to claim 4, wherein the abutment is arranged in a central portion of the lower arm of the central body, and has a convex upper free edge.

6. Grip for carrying bags having loop handles, or other loads according to claim 1, wherein the hooks have an inlet oriented upwardly, in a direction of a median portion of the central body, and wherein walls demarcating said inlet converge in a direction of an end of a housing demarcated by said hooks.

7. Grip for carrying bags having loop handles, or other loads according to claim 1, wherein the hooks have an inlet oriented upwardly, in a direction of a median portion of the central body, and demarcated by a free end portion of said hooks which extends above an end of said central body, and wherein an inner surface of said free end portion is provided with a boss that is in contact with an upper surface of the end of the central body.

* * * * *